United States Patent [19]

Larkin

[11] Patent Number: 5,020,751

[45] Date of Patent: Jun. 4, 1991

[54] GARBAGE BAG AND UTILITY HOLDER

[75] Inventor: Patrick J. Larkin, Edmonton, Canada

[73] Assignee: Easybagger Inc., Edmonton, Canada

[21] Appl. No.: 425,070

[22] Filed: Oct. 23, 1989

[51] Int. Cl.[5] ..... B65B 67/12

[52] U.S. Cl. ..... 248/99

[58] Field of Search ..... 248/95, 99, 100, 101, 248/223.4, 224.1, 224.2, 315; 141/314, 391

[56] References Cited

U.S. PATENT DOCUMENTS

| | | | |
|---|---|---|---|
| 163,531 | 5/1875 | Roake | 248/222.4 |
| 214,721 | 4/1879 | Smith | 248/99 |
| 544,585 | 8/1895 | Mayo | 248/100 |
| 922,630 | 5/1909 | Reach | 248/315 |
| 1,557,254 | 10/1925 | King | 248/95 |
| 1,664,658 | 4/1928 | Blazer | 248/101 |
| 2,716,533 | 8/1955 | Freeman | 248/222.4 |
| 3,664,434 | 5/1972 | Connor | 411/401 |
| 3,991,961 | 11/1976 | Platzer . | |
| 4,312,489 | 1/1982 | Paetzold . | |
| 4,488,697 | 12/1984 | Garvey . | |
| 4,805,858 | 2/1989 | Taylor | 248/99 |

FOREIGN PATENT DOCUMENTS

| | | | |
|---|---|---|---|
| 820734 | 8/1969 | Canada . | |
| 1004208 | 1/1977 | Canada . | |
| 1101819 | 5/1981 | Canada . | |
| 1237114 | 5/1988 | Canada . | |
| 968738 | 9/1964 | United Kingdom | 248/101 |
| 2212383 | 7/1989 | United Kingdom | 248/95 |

*Primary Examiner*—Ramon O. Ramirez
*Assistant Examiner*—Robert A. Olson
*Attorney, Agent, or Firm*—Anthony R. Lambert

[57] ABSTRACT

A garbage bag holder is provided that has a strengthened support and interchangeable attachments for attaching the holder to various surfaces, including stadium seats. A ring, elongated in a direction perpendicular to the plane of the ring, is provided to hold the garbage bag. A plate is attached to the ring using a reinforced arm, and the plate is designed to fit inside a bracket the bracket being attachable to the surface on which the holder is to be fixed. Various constructions to the bracket permit it to be attached to a fence, a uniform vertical surface, a horizontal surface, and the arm of a stadium seat. An alternative embodiment shows a hand held bag holder. A system is also provided for cleaning sport stadiums which includes the bag holder and a tray for receiving garbage from steps.

2 Claims, 5 Drawing Sheets

GARBAGE BAG AND UTILITY HOLDER

FIELD OF INVENTION

This invention relates to garbage bag or utility holders, for use in supporting flexible or rigid cup-shaped containers.

BACKGROUND OF THE INVENTION

Various garbage bag holders have been provided in the past that include a ring, means for retaining a bag on the ring and a support of some kind. Examples of these include Paetzold, U.S. Pat. No. 4,312,489, Platzer, Jr., U.S. Pat. No. 3,991,961, Govoni et al, Canadian Patent No. 1,004,208, Bumgarner et al, Canadian Patent No. 820,734, Garvey, U.S. Pat. No. 4,488,697, Dougard, Canadian Patent No. 1,101,819, and McEniry, Canadian Patent No. 1,237,114.

However, none of these prior art bag holders have the strength for use in a wide variety of applications including gardening and stadium clean-up. In addition, none of these prior art bag holders have the adaptability to be attached to a wide variety of surfaces, and for holding a variety of cup-shaped containers.

SUMMARY OF THE INVENTION

The invention provides an improved garbage bag and utility holder which addresses these prior art problems, and in one aspect provides a garbage bag holder for attachment to an object comprising: a ring; means for attaching a garbage bag to the ring; a plate attached to the ring and having an edge; a bracket having means for receiving and retaining the edge of the plate; and the bracket being attachable to the object.

In another aspect, the invention provides a portable garbage bag holder comprising: a ring; the ring defining a plane and being elongated in a direction perpendicular to the plane; means for retaining a garbage bag on the ring; and a handle attached to and extending away from the ring.

Further embodiments of the invention may be found in the claims.

BRIEF DESCRIPTION OF THE DRAWINGS

There will now be described preferred embodiments of the invention with reference to the drawings, for purposes of illustration only, in which.

DETAILED DESCRIPTION OF PREFERRED EMBODIMENTS OF THE INVENTION

Figure 1:
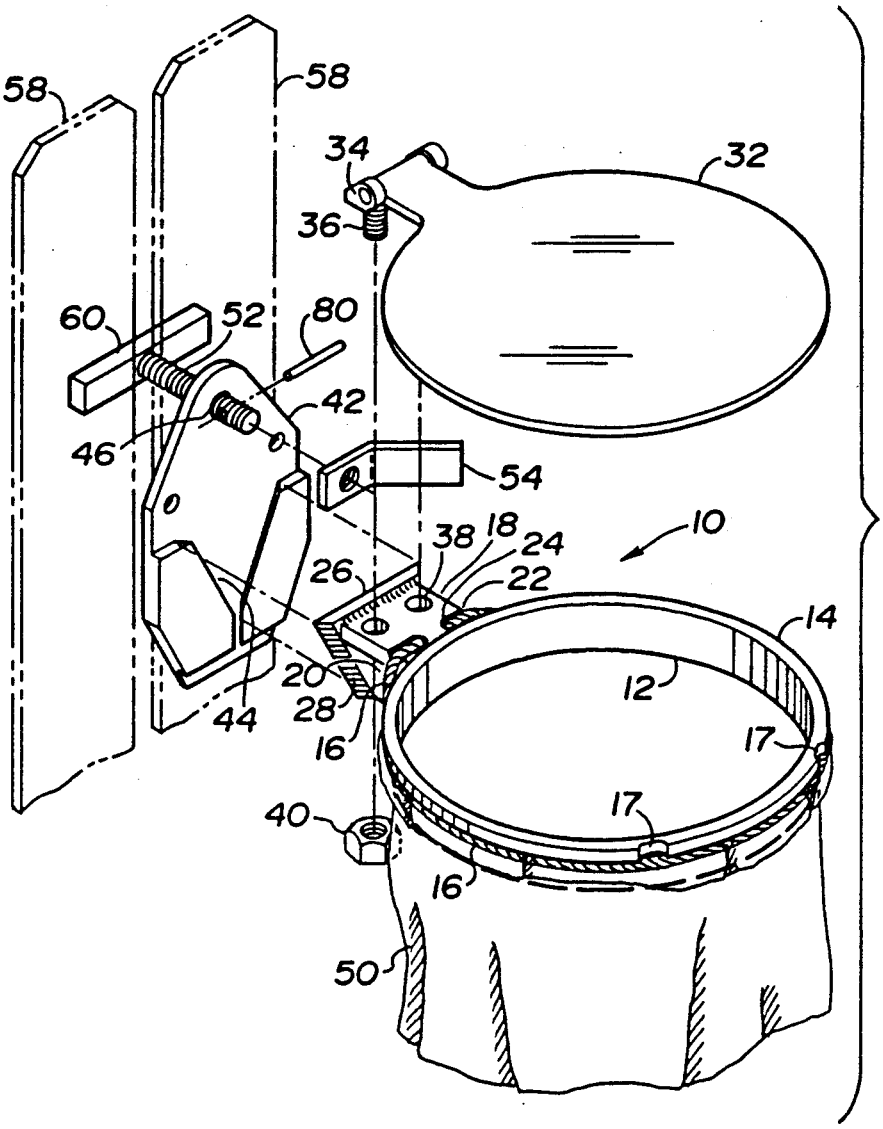
FIG. 1 is an exploded perspective view of a garbage bag holder according to the invention.
Figure 2:
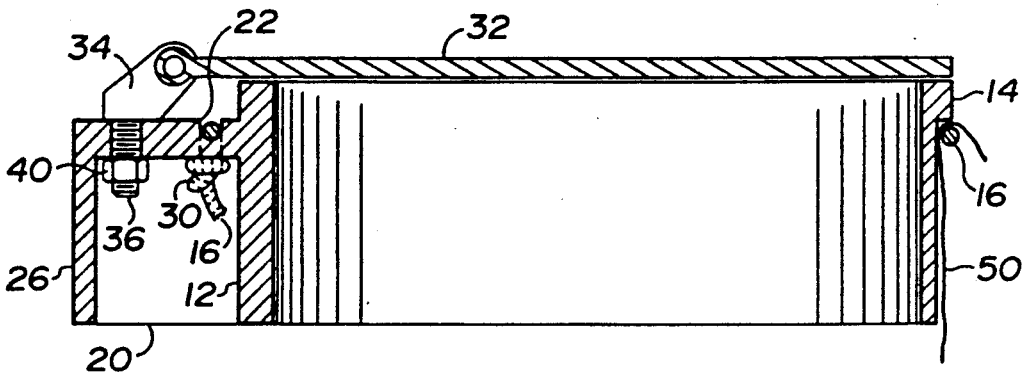
FIG. 2 is a section through the garbage bag holder of FIG. 1.

Referring to FIGS. 1 and 2, there is shown an embodiment of a garbage bag holder 10 with a removeable mounting bracket 42 for attachment to a fence 58. The garbage bag holder 10 includes a ring 12 for supporting a garbage bag 50. In FIG. 1, the garbage bag 50 is retained on the outside of the ring 12 by a cord 16, preferably made of an elastic material. While the garbage bag 50 has been shown on the outside of the ring 12, greater strength may be obtained by installing the garbage bag 50 on the inside of the ring and having the outer edge fall down on the outside of the ring, so that the weight of material in the garbage bag 50 pulls the upper edge of the garbage bag 50 and the cord 16 up against the lip 14 which surrounds the ring 12. The cord 16 is held in place around the ring 12 by being placed through holes 24 and being knotted as shown at 30 to prevent the cord 16 slipping through the holes 24. Grooves 22 are provided in the arm 18 for the cord 12. The ring 12 may include cut-outs 17, for example at 30° from the centre facing front, for easy access to the cord 16.

Arm 18 is provided to attach the V-shaped mounting plate 26 to the ring 12. Brace or gusset 20, perpendicular to the arm 18, is provided to give additional strength to the arm 18. The ring 12 is elongated in a direction perpendicular to the plane of the ring, so that it has the form of a truncated tube. The brace 20 abuts against the ring 12 and plate 26 to give structural strength to the connection between the ring 12 and the V-shaped plate 26 formed by the arm 18 and brace 20.

The ring 12, together with arm 18, brace 20 plate 26, and bracket 42 may be made of any suitably strong material, preferably also light, such as a plastic, for example, Tenite TM polypropylene (240G/20% P2635-08A) available from Eastman Chemical Products Inc. of Kingsport, Tenn.

The ring 12 is provided with a lid 32 attached to hinge 34, which may be bolted onto the arm 18 by bolts 36 passing into holes 38 of the arm 18. The lid 32 is particularly useful for situations where the garbage bag holder 10 is used indoors. Bolts 36 are secured by nut 40 through the arm 18.

The V-shaped plate 26 is provided with bevelled edges as shown at 28 for mating with the complementary V-shaped groove 44 in removable mounting bracket 42.

The bracket 42 is provided with a hole 46 for receiving bolt 52 having tightening nut 54. The T-bar end 60 of bolt 52 permits the bracket 42 to be secured between two fence boards of a fence 58. Pin 80 is provided so that the nut 54 may be tightened without turning the bolt 52. The orientation of the bolt 52 may be changed readily so that it may be removed or adjusted.

Figure 3:
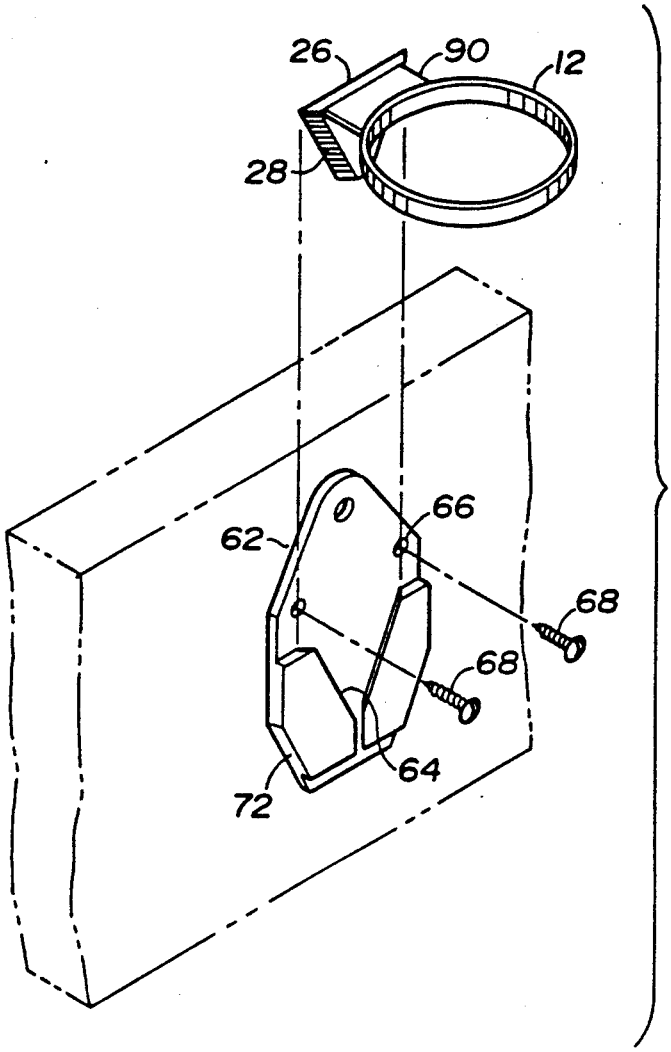
FIG. 3 is a perspective view of an embodiment of a utility holder including a bracket according to the invention.

Referring to FIG. 3, there is shown a second embodiment of a mounting bracket 62 for attachment to a vertical surface. V-shaped groove 64 is provided to receive the V-shaped plate 26 with bevelled edges 28. Holes 66 are provided for screws 68. The lower edges of the mounting bracket 62 have cut off corners 72 for ease of manufacturing. The bracket 62 is preferably made from injection molded plastic, and to permit the use of injection molding equipment, may include slots or openings, (not shown) parallel with and behind the grooves. This allows the bracket 62 to be easily removed from the mold. Since the slots or openings tend to weaken the bracket 62, the lower end 65 of the bracket 62 may be extended to give it additional strength.

In FIG. 3, a second embodiment of a ring 12 is shown that is attached to plate 26 by arm 90 and which does not include holes for lid bolts or for a cord. This ring 12 is designed to receive, for example, a flower pot (not shown) that may sit in the ring 12.

Figure 4:
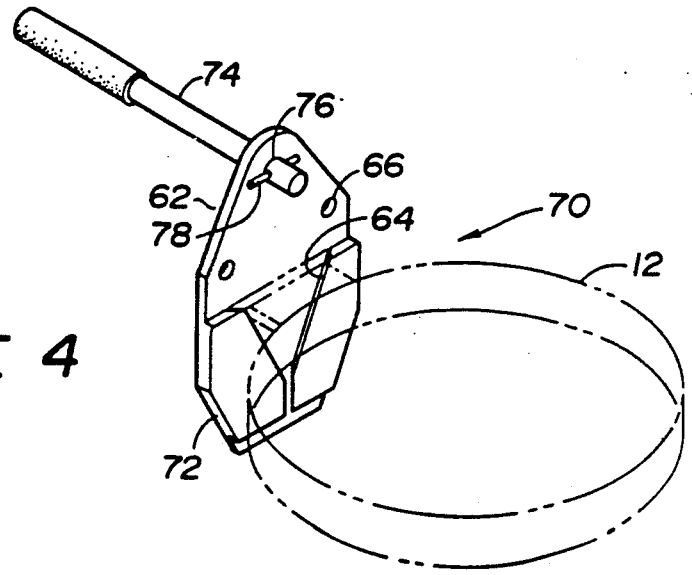
FIG. 4 is a perspective view of an embodiment of a bracket for a garbage bag holder, including a ring shown in ghost outline according to the invention.

Referring to FIG. 4, there is shown a hand-held bag holder 70, having a mounting bracket 62 similar to that shown in FIG. 3. However, handle 74 mounted in hole 76 with retaining pin 78 is provided so that a ring, such as the ring 12 shown in ghost outline, may be held by hand.

Figure 5:
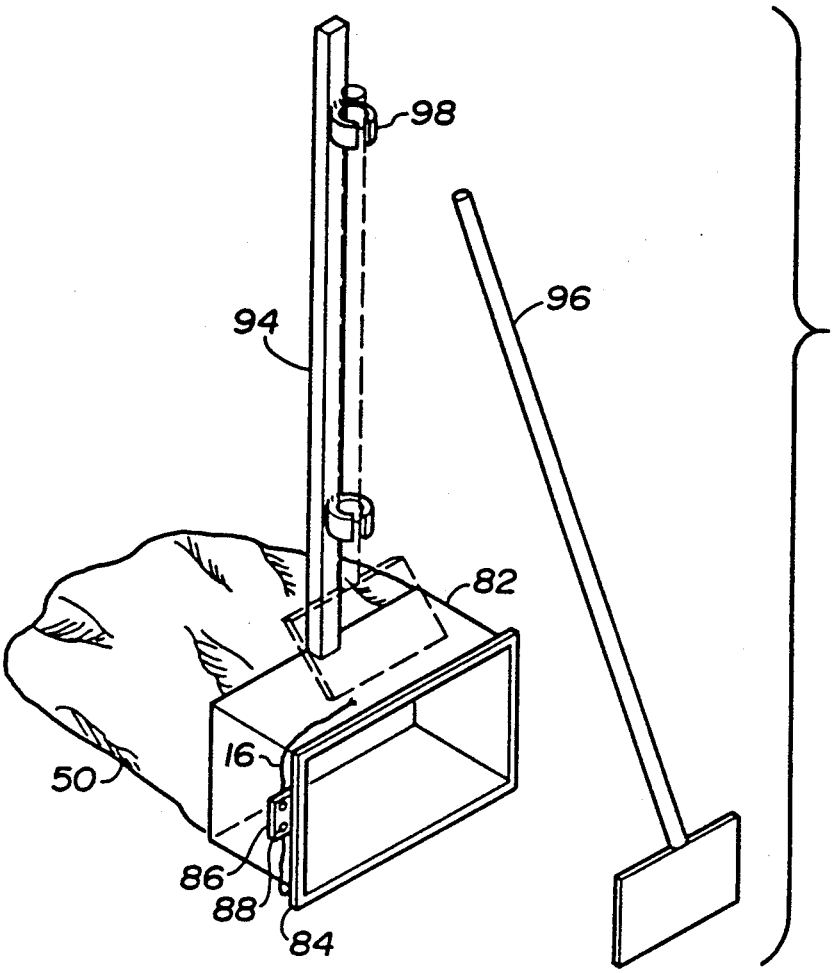
FIG. 5 is a perspective view of an embodiment of a garbage bag holder according to the invention for use in removing garbage from the ground.

Referring to FIG. 5, there is shown a second embodiment of a hand-held bag holder having a rectangular ring 82 for use as a pooper scooper. The ring 82 is preferably sized to fit a plastic grocery bag. Cord 16 is provided for securing a plastic garbage bag on the retaining ring 82. Retaining ring 82 is provided with lip 84 so that when the garbage bag 50 is placed inside the retaining ring 82 and folded back outside the retaining ring 82 with the cord 16 in place, pulling on the garbage bag 50 forces the cord 16 up against the lip 84 to provide resistance from the pulling motion of the garbage bag 50. Holes 88 are provided in arm 86 for securing the cord 16. Handle 94 is provided for holding the retaining ring 82. Shovel 96 is provided for scraping dog poop from the ground into the garbage bag, and the handle 94 is provided with clamps 98 for holding the shovel 96 when it is not in use.

Figure 6:
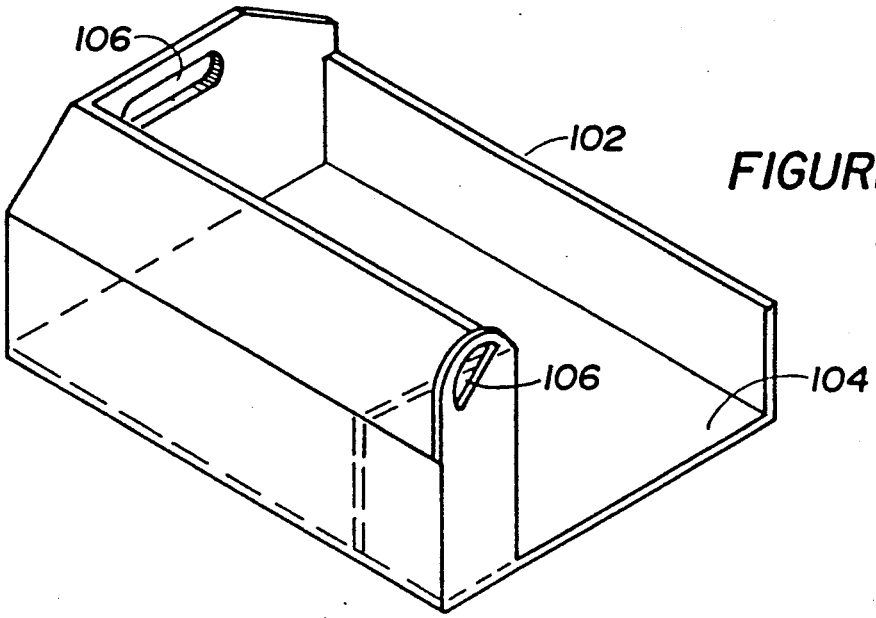
FIG. 6 shows a perspective view of a tray used in a system according to the invention.

Referring to FIG. 6, there is shown a tray 102 with open end wall 104 and handles 106. This tray 102 is used in stadium clean-uP applications. Garbage may simply be scraped into the tray (situated on a lower step for example) using, for example, a brush (not shown) and then deposited in a garbage bag, for example, as held by a mounting bracket according to the invention supported by one of the clamps shown in FIGS. 7 and 8.

Figure 7:
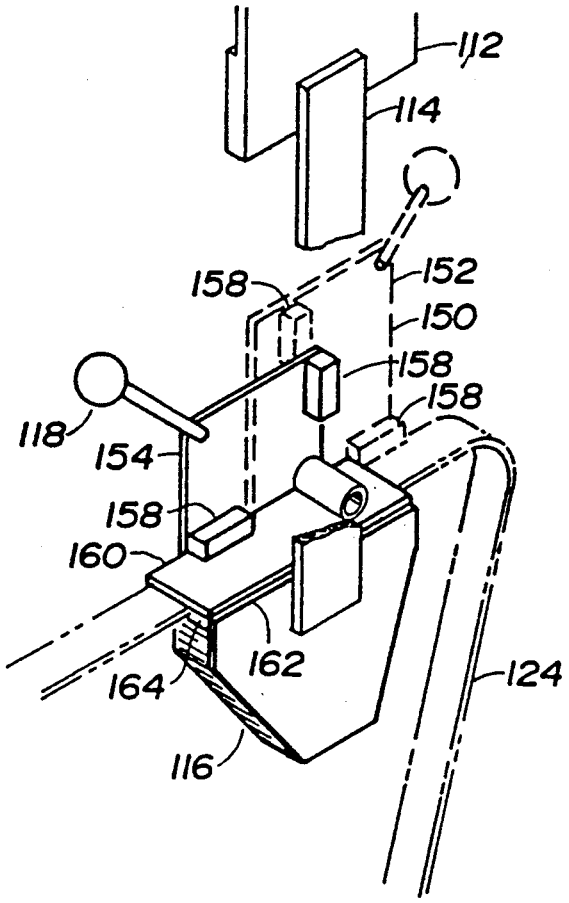
FIG. 7 is a perspective view of a bracket for attachment to a stadium seat and for holding a garbage bag holder according to the invention.

Referring to FIG. 7, there is shown bracket 112 similar to bracket 62 or 42. Post 114 is provided for holding the bracket 112 at a convenient height above the ground such that a garbage bag placed in a garbage bag holder attached to the bracket 112 will not be excessively bunched up against the ground. Clamp 116 with upper plate 160 and lower plate 162 defining slot 164 is provided for attachment of the post 114 and bracket 112 to the arm of the seat at a stadium as shown at 124. The arm of the seat slips easily into slot 164. Handle 118 is provided for adjustment of the clamp 116, which is secured to the arm of the seat of the stadium by movement of the handle 118 together with plate 150 from the position 152 shown in ghost outline to the position 154. The plate 150 swivels about pin 156. Stops 158 on the plate 150 prevent excessive movement of the plate 150. The lower end 166 of the plate 150 prevents the clamp 116 from slipping off the arm.

Figure 8:
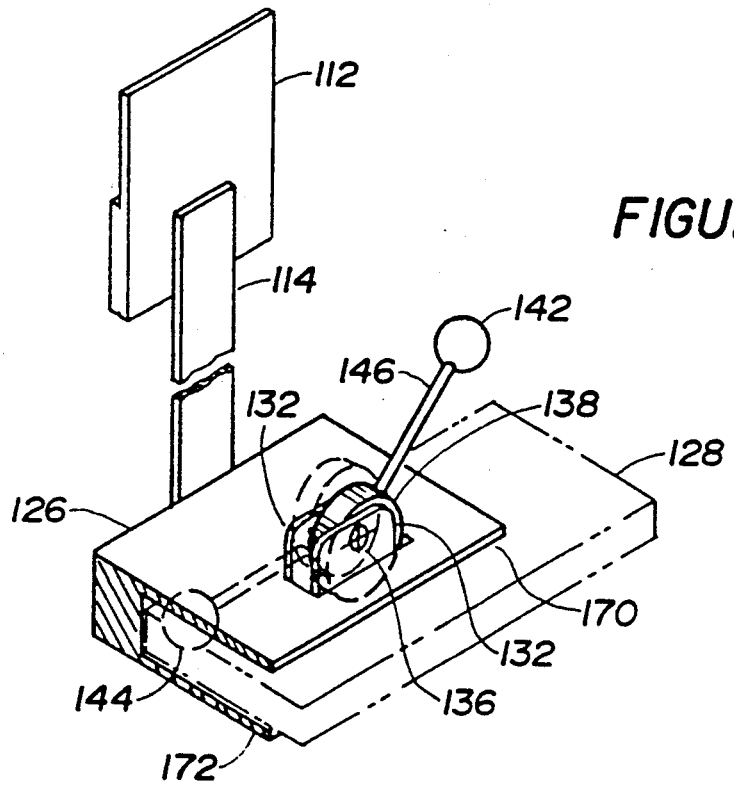
FIG. 8 is a perspective view of a bracket for a garbage bag holder according to the invention for attachment to a stadium seat.

Referring to FIG. 8, clamp 126 is an alternative embodiment of clamp 116 for attachment of a post 114 and bracket 112 to the horizontal portion of the seat at a stadium as shown at 128. The clamp 126 includes upper plate 170 and lower plate 172 for receiving the seat 128 and parallel plates 132 with holes 134 for receiving axle 136. The axle 136 provides a fulcrum for the disk or cam 138 which has a hole for receiving the axle 136 off-set from the centre of the disk. Lever 142 is provided for rotation of the disk 138 from a first position at 144 in which the clamp is loose on the seat to a second position as shown at 146 in which the clamp is fastened to the seat.

Figure 9:
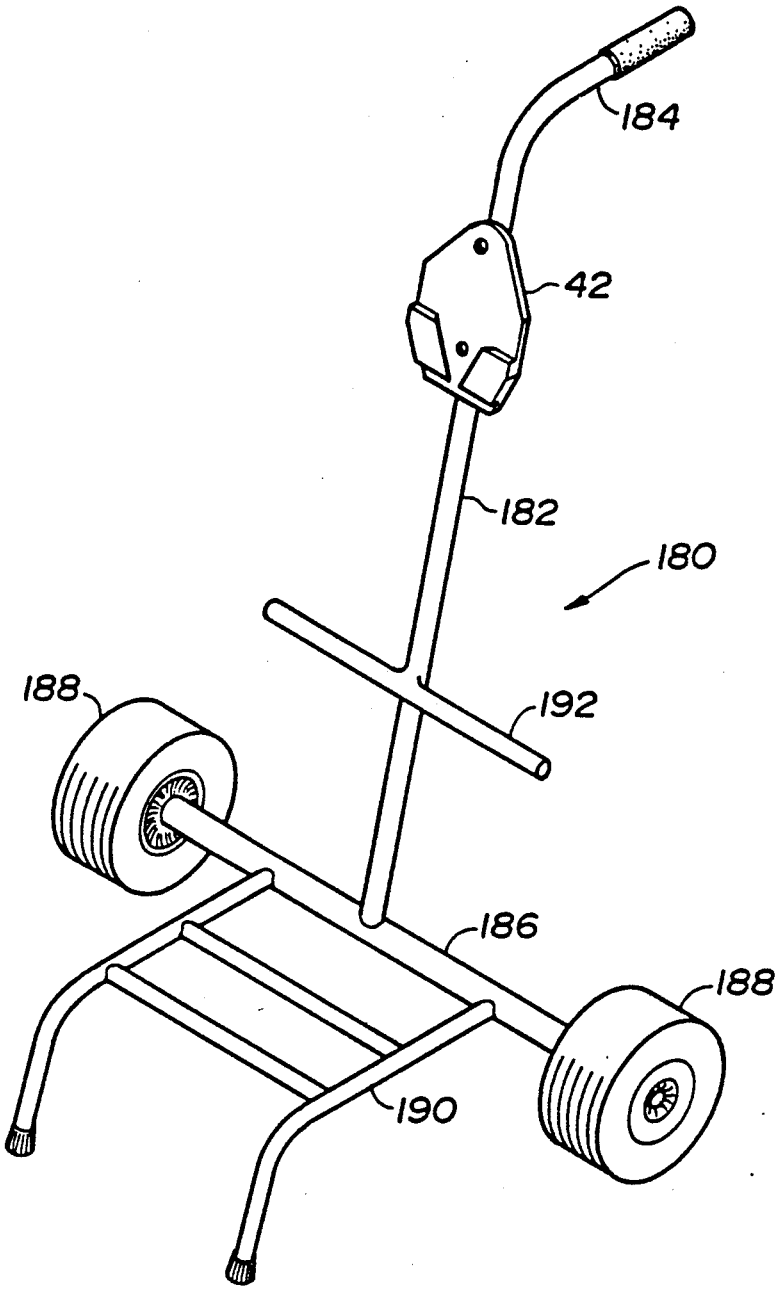
FIG. 9 is a perspective view of a cart for supporting a garbage bag holder according to the invention.

FIG. 9 shows a cart 180 for holding a bracket 42. The bracket 42, similar to the bracket shown in FIGS. 1, 2, 3 and 4, is secured to the cart 180 by screws or bolts 182. The cart 180 is formed by upright support 182 with extension 184 forming a handle, cross-piece 192 connected to the support 182 below the bracket 42, cross-piece 186 secured to the lower end of support 182, wheels 188, rotatably mounted at opposing ends of the cross-piece 186, and base 190, all of which may be formed from steel tubing and welded together as is well known in the art. The bracket 42 may have its height adjusted to suit any particular sized bag.

It will be clear from the above descriptions that the basic combination of ring, supporting plate and bracket may be used in any of a variety of situations, the bracket being attached to any of various objects. Thus, the bracket may be attached to a wall as shown in FIG. 3, attached to a fence as shown in FIG. 1, attached to a handle as shown in FIG. 4, or attached to a post for attachment to a stadium seat as shown in FIGS. 7 and 8. In addition, the ring itself may have a handle attached to it as shown in FIG. 5.

For commercial applications, such as use in a stadium, and for withstanding the rugged use that may be expected in many gardening applications, the ring 12 has been constructed with structural support from the brace 20 abutting against the axial extension of the ring 12.

For use in stadium applications, garbage may be swept into the bag for example by using the tray shown in FIG. 6, and emptied into garbage bags held by the construction shown in FIGS. 7 and 8. In addition, the construction shown in FIG. 5 is preferably used as a pooper scooper.

It will be appreciated that immaterial modifications may be made to the invention described, and that these are intended to be covered by the scope of the claims that follow.

For example, while one preferred method of attaching the plate 26 to the bracket 42 has been shown, others could be used, such as may be created by inverting the V-shaped groove, and by providing the plate 26 with a complementary inverted V-shaped groove.

Also, a means for attaching a garbage bag to the ring 12 has been described that is particularly easy to use and that gives good strength. However, other means could be used that would give the same result, although, it is believed, not in such an efficient manner.

I claim:

1. A garbage bag holder for attachment to a variety of objects comprising:

a ring having an edge defining a plane, and the ring being elongated in a direction perpendicular to the plane;

the edge forming a lip extending outward from and surrounding the ring;

means for attaching a garbage bag to the ring, including an arm extending from the ring, a cord having sufficient length to extend around the ring adjacent the lip and having first and second ends, and first and second ends in the arm for receiving and retaining the first and second ends of the cord;

a V-shaped plate rigidly attached to the ring and having bevelled edges, the plate being attached to the ring by the arm and further including a brace extending between the plate and the arm;

a bracket having a complementary groove for receiving and retaining the bevelled edges of the V-shaped plate; and the bracket including a first hole for receiving a bolt and a plurality of smaller holes for receiving screws and thereby being attachable to a variety of objects.

2. The garbage bag holder of claim 1 in which the arm includes first and second grooves adjacent the first and second holes in the arm for receiving the cord, and further including a lid shaped to fit the ring and being attached to the arm.

* * * * *